United States Patent [19]

Bodden et al.

[11] Patent Number: 4,508,681

[45] Date of Patent: Apr. 2, 1985

[54] METHOD OF MAKING SURFACE-HARDENED SINTER-IRON PART

[75] Inventors: Werner Bodden; Winfried Diegelmann, both of Heuchelheim, Fed. Rep. of Germany

[73] Assignee: Schunk & Ebe GmbH, Postfach, Fed. Rep. of Germany

[21] Appl. No.: 564,350

[22] Filed: Dec. 21, 1983

Related U.S. Application Data

[63] Continuation of Ser. No. 301,238, Sep. 11, 1984, abandoned.

[30] Foreign Application Priority Data

Sep. 23, 1980 [DE] Fed. Rep. of Germany ..... 3035772

[51] Int. Cl.[3] ..... B22F 3/00

[52] U.S. Cl. ..... 419/29; 148/14; 148/126.1; 419/26

[58] Field of Search ..... 148/126.1, 14; 419/26, 419/29

[56] References Cited

U.S. PATENT DOCUMENTS 4,071,382 1/1978 Riopelle ..... 419/29 X

FOREIGN PATENT DOCUMENTS 2050576 4/1972 Fed. Rep. of Germany .

*Primary Examiner*—Leland A. Sebastian
*Attorney, Agent, or Firm*—Max Fogiel

[57] ABSTRACT

A method is provided for making a surface-hardened sinter-iron part by impregnating the sinter-iron part with an alkali silicate solution, hardening the iron part by heat treatment to harden the surface of the part, the sinter iron part having closed pores on the upper surface.

5 Claims, 1 Drawing Figure

METHOD OF MAKING SURFACE-HARDENED SINTER-IRON PART

Figure 1:
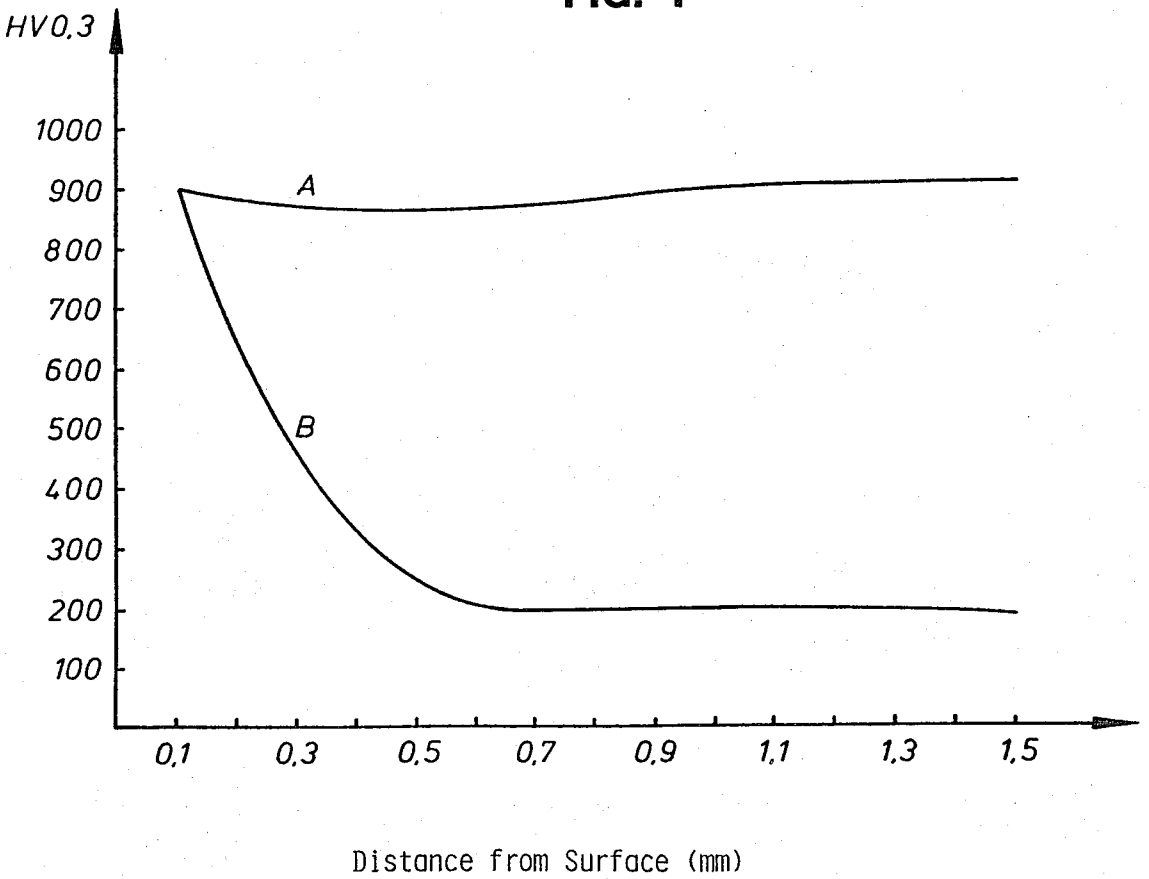

This application is a continuation of application Ser. No. 301,238 filed Sept. 11, 1984, now abandoned.

The invention relates to a method of making a surface-hardened sinter-iron part wherein a sinter-iron part is powder-metallurgically produced and the sinter-iron part is subjected to a heat treatment suitable for hardening of iron parts.

Sinter-iron parts can be substantially improved in their characteristics by a following heat treatment. Such heat treatment methods for obtaining greater hardness are carbonizing as preliminary stage, and hardening, case hardening, nitriding and oxydizing as the actual hardening methods. Carbonizing of sinter-iron-parts in carbon-yielding means takes place preferably in a gas atmosphere at temperatures between 820° and 930° C. Hardening is effected by subsequent quenching, preferably in an oil bath.

Case hardening is the term used for carbonizing or carbonitriding with direct following quenching. Carbonitriding, in which in addition to carbon-yielding media also nitrogen yielding media are used, is carried out at temperatures of 720° to 950° C. This method allows the production of surfaces of high wear resistance.

Heat-treatment in nitrogen-yielding media, nitriding at temperatures of 480° to 580° C., also produces hard, wear-resistant surfaces. Finally, there should be mentioned the treatment of sinter-iron parts in superheated water vapor, which also produces an increase in hardness and wear resistance in addition to an increase in corrosion resistance. In this method an iron-oxide layer, namely magnetite ($=Fe_2O_3$) is formed.

The concept of heat treatment in this paper thus corresponds to the definition as given in the material guidance sheet "Heat Treatment of Sinter-Metal Parts", Sint 06, Issue 1979, issued by the powder-metallurgy association in Benth Verlag GmbH, Berlin 30 and Koeln 1, and includes all methods which were there mentioned in Section 3.

In contrast to massive iron parts, in which hardening after carbonizing, carbonitriding or nitriding readily produce a defined surface hardening, this is not possible in sinter-metal parts without special measures. Gaseous or liquid treating media can enter into the sinter-metal part through the open pores which are accessible from the surface. True, this phenomenon depends upon space filling or sinter density. Thus it is stated (opun cit.) that given a space filling of about 85%, which corresponds to a sinter density of about 6.6 g/cm$^3$, carbonizing must always be expected to produce through-carbonizing, i.e. will lead after quenching to through-hardening.

However, it is freguently desired to obtain exclusively a surface hardening. The limitation of carbonizing to a boundary layer is possible only from a space-filling of more than 90%, corresponding to a sinter-density of 7.0 g/cm$^3$. The requirement for a sinter-iron part with a lesser space filling and simultaneous surface hardening could not heretofore be fulfilled.

Various degreasing methods are known as preliminary treatments prior to the heat treatment.

For another purpose, namely to increase the corrosion-resistance of sinter-metal parts, these are impregnated at least at the surface with an alkali-silicate according to a German Published Application and are hardened as a silicate.

The impregnation of sinter-metal parts with alkali-silicate is known from German Pat. No. 2050576 as pretreatment of sinter-metal bodies, on which a metal layer is to be applied using metal-salt baths.

The purpose of the invention is to provide a method which permits the creation of a surface-hardened sinter-iron part with a defined depth of hardening, independently of its space-filling or sinter-density.

The problem is solved in that the sinter-iron part is impregnated prior to effectuation of the heat treatment with an alkali-silicate-solution, that the alkali-silicate-solution adhering to the surface of the sinter-iron part is flushed off, and that the impregnated sinter-iron part is dried at elevated temperature. Preferably, a natrium-silicate-solution is used as the alkali-silicate-solution.

The advantages of the present invention reside in that it now is also possible to provide relatively porous sinter-iron parts by a normal heat treatment for hardening purposes with a very wear resistant surface layer, without thereby changing the characteristics of the core of the sinter-iron part.

A further important advantage resides in the fact that with the reduction of the entry of carbon, nitrogen or oxygen into the interior of the body, the volume increase of the sinter-metal part resulting from the absorption of foreign atoms is avoided. This makes it possible, even in the case of surface-hardened sinter-metal parts, to maintain the IT6 and IT7 tolerances which are normally to be maintained for sinter-metal parts. The previous case hardening, however, permits only tolerance ranges of IT9.

Also not to be overlooked is the fact that the corrosion-resistance of the sinter-metal parts is substantially increased by cladding of the pores with alkali-silicate.

Hereafter the inventive method will be explained by way of example. After the sintering process the sinter-metal parts are evacuated in a container to which a pump and a reservoir of alkali-silicate solution are connected, until a vacuum of 4 to 2 torr is reached. With the vacuum pump still running, the valve to the pump is closed and the valve to the reservoir is opened, so that the alkali-silicate-solution can flow in in a strong stream. When the impregnation liquid has reached a height of about 5 cm above the sinter parts, the addition of impregnated solution is interrupted and the vacuum in the container is slowly collapsed. Now the sinter-metal parts remain for about 30 minutes at atmospheric pressure in the alkali-silicate solution. The sinter parts are now taken out of the solution. They are allowed to drip off and are finally flushed with cold water. Flushing is either carried out by repeated immersion in water or the parts are dried in air or with oil-free compressed air and stepwise heated in the drying vessel from 50° to 180° C. and dried. The drying temeprature can selectively and without disadvantages even be further increased, which will be the case when the drying is carried out in the same oven in which the hardening is to be effected.

The particular advantages of the invention using alkali-silicate-solution reside in the exceedingly low cost of the impregnating medium itself, further in its low viscosity which permits a simple use. In addition, the alkali-silicate-solution is not combustible, without scent and has no toxic characteristics. In closed storage containers it exhibits no aging effects or hardenings.

Due to the wetting of the metal only a short impregnating time is needed. In comparison to those of other impregnants, the drying times are relatively short. After hardening of the impregnant the above-mentioned heat treatment methods for hardening of iron parts can be used. Since the pore walls are now largely protected by the alkali-silicate against the entry of carbon, nitrogen and oxygen, carbonization, carbonitriding, nitriting or oxydation takes place only at the surface. The entry of these elements into the sinter-iron is thus—analogously to massive iron parts—controlled only by the diffusion speed of the foreign atoms in the metal. From this it follows that the deposition of the foreign atoms takes place only in a surface layer so that surface hardening with a controlled depth of hardening is obtained.

The following example is given for better understanding of the invention.

A sinter-iron part was produced from a standard iron powder without any other additions, by pressing the sinter powder and annealing the pressed blank in a non-oxydizing atmosphere. The density was 6.6 g/cm$^3$, the space filling was 84%. Some of the sinter-iron parts were impregnated with natrium-silicate-solution, flushed and dried at 180° C. according to the above-described method. This treatment was not carried out for the remaining sinter-iron parts. Both the impregnated and the non-impregnated sinter-iron parts were subjected to the same carbonization. The carbonization time was 2 hours at a temperature of 870° C.; endogas with a dewpoint of −2° C. was used as the carbonization medium.

Hardening was effected by subsequent quenching in an oil bath. Thereafter the parts were cut open and their Vickers-hardness HVO.3 was measured at different distances from the surface. The measuring result is shown in FIG. 1. The curves show the hardness in dependence upon the distance from the surface.

Curve A, measured for parts without natrium-silicate impregnation, shows that up to a depth of 1.5 mm from the surface the hardness is practically constant. By contrast, the curve B for the part having had nitrium-silicate treatment drops steeply and reaches at about 0.5 mm depth already the value of the starting material prior to hardening.

We claim:

1. Method of making a surface-hardened sinter-iron part, comprising the steps of: producing a sinter-iron part by powder-metallurgy; impregnating the sinter-iron part with an alkali-silicate-solution; flushing off the alkali-silicate-solution adhering to the surface of the sinter-iron part; drying the impregnated sinter-iron part; and subjecting the sinter-iron part to a heat treatment for hardening said iron part; said impregnating step before said heat treatment step protecting said part against corrosion and producing an exclusively hardened surface of said part, said part after said heat treatment step having a predetermined depth of hardening independent of space filling and sinter density of the part, said part being resistant to gas penetration at elevated temperatures, said part having pores with upper surface closed by a substantially thin layer produced by said impregnating step so that a substantial residual porosity remains in said part for allowing fluids to stream freely through said part; said substantially thin layer being a glass-like protective layer located over walls of said pores to prevent gas from penetrating into metallic structure of said part; only exterior surfaces of said part which are free from silicate due to said flushing step becoming hardened; said impregnating step with said silicate solution preventing full-depth hardening throughout the part without filling said pores; said part being able to receive and retain substantial fluid for functioning as a porous sintered bearing part.

2. Method according to claim 1, wherein said alkali-silicate-solution is sodium-silicate-solution.

3. Sinter-iron part manufactured according to a method as set forth in claim 1 or claim 2, comprising a sinter-iron part impregnated with an alkali-silicate-solution which was flushed off the surface of the part after adhering thereto, said sinter-iron part being dried after flushing off said solution, said sintered part after drying being hardened by heat treatment.

4. A method as defined in claim 2, wherein said part is placed in a container evacuated until a vacuum of 4 to 2 torr is reached by using a vacuum pump, said alkali-silicate-solution being admitted into said container in a strong stream while said vacuum pump remains operating; ceasing the flow of said solution when the solution reaches a height of substantially 5 cm above said part and breaking the vacuum in said container; leaving said part for substantially 30 minutes at atmospheric in said solution; removing said part out of said solution; allowing solution to drip off said part and flushing said part with cold water by repeated immersion in water.

5. A method as defined in claim 2, wherein said part is produced by pressing sinter powder and annealing the pressed blank in a non-oxydizing atmosphere at a density of 6.6 g/cm$^3$ and space filling of 84% said flushing and drying steps being carried out at 180° C., surface hardness of said part being substantially constant to a depth of 1.5 mm.

* * * * *